United States Patent [19]

Foy et al.

[11] Patent Number: 4,916,457

[45] Date of Patent: Apr. 10, 1990

[54] PRINTED-CIRCUIT CROSSED-SLOT ANTENNA

[75] Inventors: Wong Foy; Hsin-Hsien Chung, both of San Diego; Sheng Y. Peng, Escondido, all of Calif.

[73] Assignee: Teledyne Industries, Inc., San Diego, Calif.

[21] Appl. No.: 205,707

[22] Filed: Jun. 13, 1988

[51] Int. Cl.[4] ..... H01Q 13/10

[52] U.S. Cl. ..... 343/770; 343/768

[58] Field of Search ... 343/767, 768, 770, 700 MS File

[56] References Cited

U.S. PATENT DOCUMENTS

| | | | |
|---|---|---|---|
| 3,210,766 | 10/1965 | Farker | 343/743 |
| 3,720,953 | 2/1972 | Ajioka | 343/771 |
| 3,969,730 | 7/1976 | Fuchser | 343/770 |
| 4,245,222 | 1/1981 | Eng et al. | 343/725 |
| 4,315,266 | 2/1982 | Haynes | 343/895 |
| 4,340,891 | 7/1982 | Phillips | 343/713 |
| 4,590,478 | 5/1986 | Powers et al. | 343/770 |
| 4,672,386 | 6/1987 | Word | 343/770 |
| 4,684,953 | 8/1987 | Hall | 343/725 |
| 4,710,775 | 12/1987 | Coe | 343/793 |

FOREIGN PATENT DOCUMENTS

| | | | |
|---|---|---|---|
| 0128903 | 10/1980 | Japan | 343/790 |
| 0165403 | 7/1987 | Japan . | |
| 1298820 | 3/1984 | U.S.S.R. . | |

OTHER PUBLICATIONS

"Standard Handbook for Electrical Engineers", by Fink and Carroll, pp. 25–74, (1968), Tenth Edition.

"Van Nostrand's Scientific Encyclopedia", 4th Edition, p, 537, (1968).

"Reference Data for Radio Engineers", 4th Edition, pp. 687–689, (1956).

"Printed Dipoles Electromagnetically Coupled to Coplanar Waveguide for Linear or Circular Polarization," Jackson, *Electronic Letters,* pp. (1986).

"A Shallow Ridged Cavity Crossed-Slot Antenna for the 240–400 MHz Frequency Range," King and Wong, *Trans. Antennas-Propagation,* pp. 687–689, (1975).

"A Shallow-Cavity UHF Crossed Slot Antenna," Lindberg, *Trans. Antennas Propagation,* pp. 558–563, (1969).

"Proceedings of Mobile Satellite Conference", pp. 16, 21, (1988), Rafferty.

"Antenna and Propagation", Foy, Chung, Peng, pp. 356–359.

"MSAT-X Phased Array Cross-Slot Element Design-"-Analysis of Low Cost Conformal Phased Array for the MSAT-X Application, by Chung, pp. 1156–1159.

"Dual Band Conformal Element", Boeing Aerospace Company, Rome Air Development Center, RADC-TR-85-137, vol. 1, Final Technical Report Mar. 1986.

"Proceedings of Mobile Satellite Conference", pp. 11–21 (1988) Rafferty.

"Printed Crossed Slot Phased Array Antenna System for Mobile Satellite Communication", H. H. Chung, W. Foy and S. Y. Peng AP-S International Symposium, pp. 204–207, Jun. 6–10, 1988.

*Primary Examiner*—Rolf Hille
*Assistant Examiner*—Doris J. Johnson
*Attorney, Agent, or Firm*—Henri J. A. Charmasson

[57] ABSTRACT

A printed circuit cavity-backed crossed-slotted conductive element having two legs of each slot coupled by stripline feeders to a radio communications device. The feeders supply the radio frequency signal with a 180 degree phase shift in order to cancel cross-coupling from one leg to another around the intersection. The conductive element and the stripline feeders are mounted on separate substrates which are attached together with other elements to provide shielding and mechanical protection. The crossed-slot design reduces space and structure required for a mobile application while achieving good performance. When mounted in an array, the crossed slot antennas may be directionally tuned to a specific satellite/frequency/direction via pin diode phase shifters.

5 Claims, 2 Drawing Sheets

PRINTED-CIRCUIT CROSSED-SLOT ANTENNA

FIELD OF THE INVENTION

This invention relates to radio wave communications and antennas, more specifically to printed plural slot type antennas for mobile applications.

BACKGROUND OF THE INVENTION

The primary objectives of a transceiver antenna are to: (1) allow quick and convenient radio communications between radio communications stations; (2) obtain acceptable transmission and reception performance gains within operating design parameters; and (3) selectively reject noise or invalid input or output signals. It also must be capable of tolerating changes in direction or frequency and be very reliable. It should also be low profile (to reduce air drag) light weight (to minimize structural support), easy to maintain, rugged in construction, pleasing in appearance and low in cost. When the antenna is used in each of the two operating modes (receiving and transmitting), a minimum of effort to convert from one mode to another mode is also desirable. If the antenna is to be used on a mobile installation, it must also be able to perform in a difficult environment and with the power, space and other limitations of the vehicle or other mobile installation.

Typical earth bound mobile transceivers currently employ quarter-wave whip antennas (see: *Standard Handbook for Electrical Engineers*, Tenth Edition, by Donald G. Fink and John M. Carroll, editors, McGraw-Hill, 1968, New York, page 25–74). A fairly uniform omnidirectional vertical polarity pattern is obtained from such installations. However, these antennas are low gain antennas which will not meet current satellite land mobile and airborne communication system requirements. In addition, these low gain antennas are subjected to multipath interference effects.

The use of dipole elements in an antenna can be as simple as a straight radiator fed in the center to produce currents with two nodes, one at each of the far ends of the radiator (see *Van Nostrand's Scientific Encyclopedia*, Fourth Edition, D. Van Nostrand Company, Princeton, N.J., 1968, Page 537). In order to improve tuning and balance, various geometries are used. Two separate radiator elements can also be used. Variations with two separate radiator elements include: altering the geometries of the nodes, folded radiators and adding/altering the dielectric between the elements.

The single slot type of antenna is a variation of the basic dipole antenna (see the section on Slot Antennas, specifically the relationship to metallic dipole antennas, *Reference Data for Radio Engineers*, Fourth Edition, Published by International Telephone and Telegraph Corporation, New York, 1956, pages 687–689, and U.S. Pat. No. 3,210 766). Each side of the slot acts as one node of an elementary dipole. The length and separation dimensions of the slot are selected to maximize performance (ie: a fraction of a normal wavelength).

In order to obtain directionally selective antenna performance, an array of slotted antennas can be formed, with each antenna in the array fed a phase controlled signal which will cancel (be out of phase) signals from adjoining antennas within the array at certain directions, and amplify (be in phase) adjoining signals in other selected directions (see U.S. Pat. Nos. 4,340,891, and 3,969,730). A plurality of slots in different orientations (either with or without an array) is also known (see U.S. Pat. No. 4,245,222). Each of the plurality of slots is excited or coupled by a feeder for each slot. Sometimes the various slots receive phase shifted signals from feeds located at opposite ends of the radiating element (see U.S. Pat. No. 3,720,953). These feeds are connected either to each side of the conductive element or to each slot.

Printed circuit slotted antennas are also known (see "Printed Dipoles Electromagnetically Coupled To Coplanar Waveguide For Linear Or Circular Polarization", by R. W. Jackson, published in *Electronic Letters*, The Institution Of Electrical Engineers, Mar. 13, 1986, Vol 22, No. 6). Again, a single feed is used for each slot.

Four feeders exciting the intersection or center of the cavity is also known (see "A Shallow Ridged-Cavity Crossed-Slot Antenna for the 240- to 400-MHz Frequency Range", by H. E. King and J. L. Wong, published in *IEEE Transactions on Antennas and Propagation, September* 1975, Pages 687–689, and "A Shallow-Cavity UHF Crossed Slot Antenna", by C. A. Lindberg, published in *IEEE Transactions on Antennas and Propagation, September* 1969, Pages 558–563. These prior art examples connect four feeds to the center or intersection of the slots. Each corner of the intersection is connected with a phase shifted signal.

Several attempts have been made to develop a low profile, high gain phased antenna array to achieve acceptable radio communication between a mobile unit and a satellite, based on printed-circuit crossed-slot antennas which have been built and tested (Proceedings of the Mobile Satellite Conference, May 3–5, 1988, Jet Propulsion Laboratory, California Institute of Technology, Pasadena Calif., pages 16 and 21). A crossed-slot element having a two point feed (one pair of conductors for each crossed slot) was originally designed and tested for this application (Antennas and Propagation, Volume 1, June 15–19th, 1987, Virgina Polytechnic Institute & State University, Blacksburg, Virginia, IEEE Antennas and propagation Society, paper entitled MSAT-X Phased Array Cross-Slot Element Design, by the inventors, page 357). The prior art of printed-circuit crossed-slot design was expected to minimize the need for a plurality of separate slots feed circuits in an array.

However, testing of this dual feed crossed slot design showed good impedance match over an acceptable bandwidth but inefficient radiation gain performance (page 357, supra). Further analysis (page 357, supra and supra Volume 11, paper entitled "Analysis of Low Cost Conformal Phased Array for the MSAT-X Applications", by one of the inventors, H. H. Chung, pages 1156–1159) and testing showed significant coupling of the radio frequency signals from one of the crossed slot legs to another.

Limitations of these prior art crossed slot antennas are primarily related to the above mentioned loss of performance and the poor gain produced within the bandwidth. Typical gains of a two point feed crossed-slot antenna are in the order of −1.0 to 0.0 dBic.

No prior art that the applicant is aware of discloses two signal stripline feeds with a 180 degree phase shift for each printed slot of the printed cross-slot.

SUMMARY OF THE INVENTION

The principal and secondary objects of the invention are:

To provide a low profile, more rugged mobile antenna especially suited to satellite communications;

To provide an antenna with wide space angle coverage and improved bandwidth and gain performance; and To provide an antenna with low cost, high reliability and less susceptible to environmental damage or impacts on performance.

These and other objects are achieved by providing printed-circuit, crossed-slot array element. This element has two orthogonal intersecting crossed slots in a cavity-backed conductive element, with the legs of each slot excited by at least two feeders. A first pair of feeders supply the radio frequency signal to each leg of each slot 180 degrees out of phase from the the opposite leg feeder. This cancels the coupled signals which would otherwise be around the intersection to the orthogonal legs of the other slot. Similarly, the second pair of feeders supply a 180 degree phase shifted radio frequency signal to opposite legs of the second slot. For a circularly-polarized element, the phase shift between two adjacent orthogonal legs is 90 degrees. For a dual limear polarized element, this 90 degreee phase shift between orthogonal slots is not required. Only the two 180 degree stripline feeders are required.

To demonstrate the element performance, a circularly-polarized printed-circuit crossed-slot element was built and tested. Measured results were excellent and confirmed the performance of the posed invention. The crossed-slot element fed by four strip line feeders was successfully employed in a 19 element electronically steered phased array which was developed for land mobile satellite communications. The overall thickness of the array is 0.75 inch, including beam forming circuitry. The array is a high gain antenna which will be steered electronically to direct the beam pointing to a satellite at all times.

DESCRIPTION OF THE PREFERRED EMBODIMENT

Figure 1:
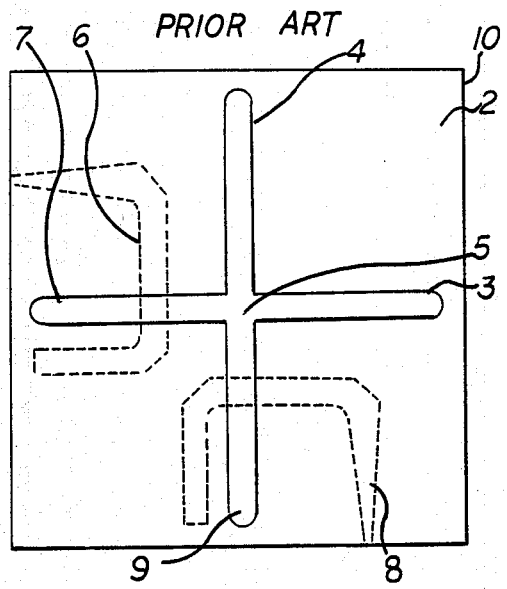
FIG. 1 shows a top view of a prior art antenna.

FIG. 1 shows a top view of a prior art antenna. Conductive plate or element 2 is a generally planar having a first slot 3 and an intersecting second slot 4 cut into the conductive element 2. Intersection 5 of the the first and second slots 3 and 4 divides each of the slots into two equal legs. The first slot 3 is fed from underneath the conductive element 2 by a first broad conductive lead or stripline feeder 6 (shown dotted for clarity). The first stripline feeder 6 is placed under the first slot 3 which actually excites the first slot 3 at first active leg 7 and is also coupled to slot 4. The second broad lead or stripline feeder 8 (again shown dotted for clarity) excites a corresponding second active leg 9 of the second slot 4 and also slot 3. The ground is not visible in this view. The edges 10 of the conductive element 2 are shorted to form an electromagnetic cavity. A phase shift of 90 degrees is incorporated into the radio frequency signals fed to the first slot 3 and second slot 4 to form a circularly polarized radiating element. The fundamental problem of this approach is the cross coupling from one slot to the other slot such as described above (one feeder excites two orthogonal slots as indicated by stripline feeder at leg 7 of slot 4 and stripline feeder at leg 9 of slot 3.

Figure 2:
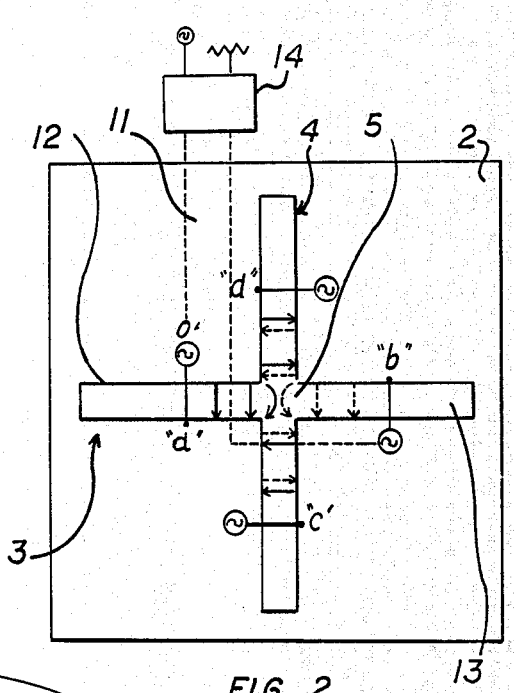
FIG. 2 shows a top view of the preferred embodiment of the printed-circuit crossed-slot antenna.

FIG. 2 is a top view of the preferred embodiment. The figure also shows how the cross coupling problem has been resolved. The conductive plate or element 2 and crossed slots 3 and 4 are essentially unchanged from the prior art shown in FIG. 1. However, a first conductive lead 11 (shown dotted for clarity) excites the first leg 12 of slot 3 by supplying a radio frequency signal (represented as a sine wave within a circle) at 0 degrees or a reference phase angle across point or area "a". The solid arrows across the slots represent the field direction patterns emanating from the inputs at point "a". The ground plane is below (into the plane of FIG. 2) the conductive element 2 (not shown for clarity).

The other leg 13 of slot 3 is now also active. It is excited by the same radio frequency signal (shown as a sine wave in a circle) at point "b", but phase shifted 180 degrees through phase shifter/signal splitter 14. Dashed arrows represent field direction patterns generated by the signals applied to point "b". The patterns of arrows show the signals being turned at the intersection 5 to the other slot 4. By supplying a signal at point "b" that is shifted 180 degrees (out of phase), the turned signals in both legs of the orthogonal slot 4 directly cancel each other. The out of phase signal also directly reinforces the first signals in both legs of slot 3. The other slot 4 is excited by the same signal (again shown as a sine wave within a circle), but shifted 90 degrees and 270 degrees, the 90 degree signal being supplied to one leg of slot 4 at point "c" (conductive lead not shown). Similar to slot 3, having a signal shifted 180 degrees exciting the opposite leg, the other leg of slot 4 at point "d" is supplied a 270 degree phase shifted signal. This feed configuration provides a circularly polarized printed crossed-slot array element.

Specific dimensions of the preferred embodiment tested were selected for an electronically steered phased array for a satellite communications application. Each slot is approximately 7.67 cm (3.02 inch) long and 0.5 cm (0.2 inch) wide. The slot intersection is generally at the mid points of each slot. The array is electronically steered by changeing phase shifter settings which will allow the beam peak pointing to the desired satellite directions. Due to the wide angle space coverage of the element radiation pattern, the low elevation angle coverage is achieved which has gains ranging from 9 to 10 dBic.

Figure 3:
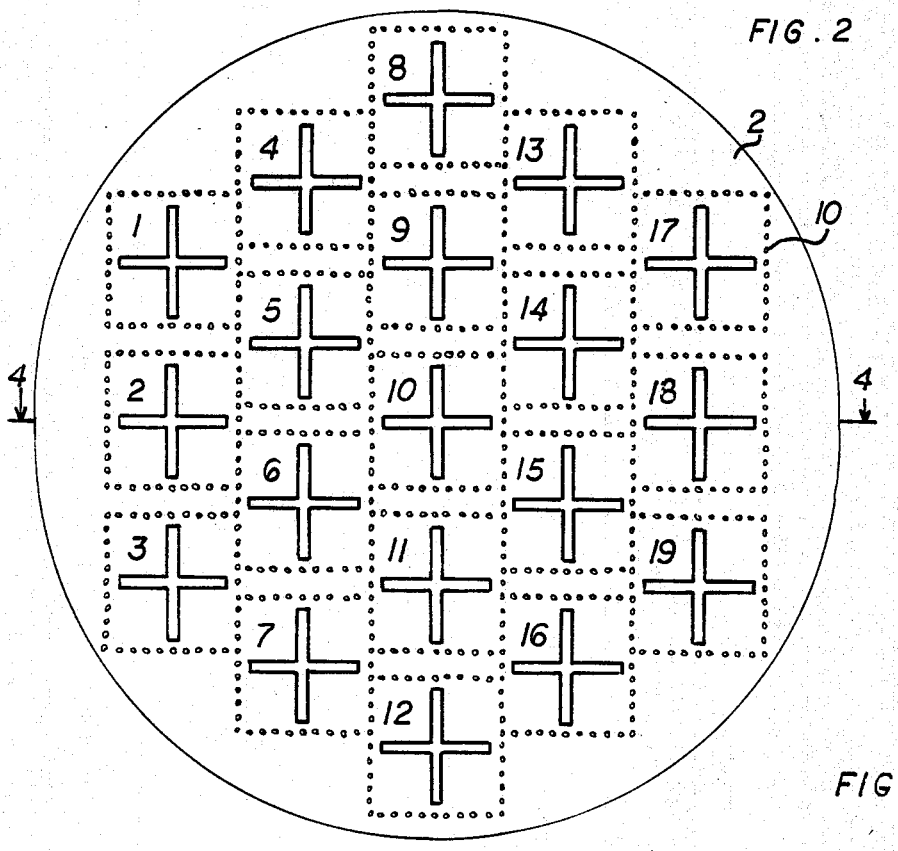
FIG. 3 is a top view of a preferred embodiment of an array of nineteen crossed-slot antennas.

FIG. 3 is a top view of a preferred embodiment of an array of nineteen crossed slot antennas. Each of the nineteen bold numbered crossed slots are etched on a cupper surface which forms the conductive element 2. Edges 10 of each antenna are shorted by conductively plated through holes, to form the required cavity.

Figure 4:
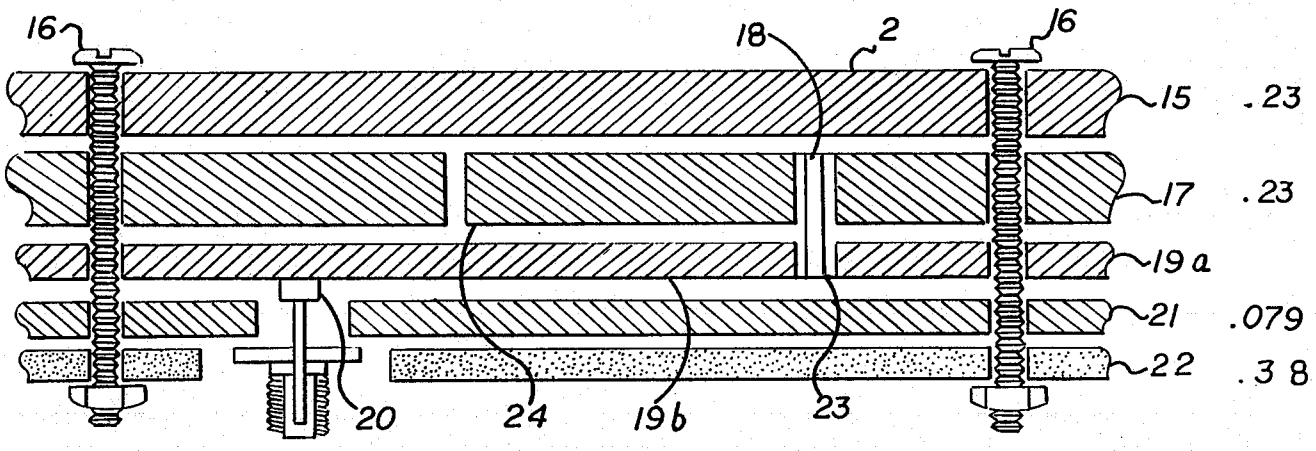
FIG. 4 shows a portion of side cross section of a portion of the array.

FIG. 4 shows a portion of side cross section 4—4 of FIG. 3. This view shows a prototype chip assembly array embodiment of the invention. The crossed slot conductive element 2 is etched in a thin layer of copper on a nonconductive slot support board 15. Screws 16 bolt slot support board 15 to a feed line board 17, having thin conductive leads or stripline feeders 18 (includes lead 11 from FIG. 2) printed on the top side of the non conductive conductive feed board 17. The screws 16 also bolt a hybrid board **19*a* to the bottom of the feed line board 17** which is also the bottom half of the cavity.

Conductive phase shift leads 19b in lengths required to shift radio frequency signals (within a band) are printed on the bottom of hybrid board 19a. Radio frequency signals are supplied to connector pin 20, which is held in contact with and provides inputs to conductive phase shift leads 19b by screws 16 holding ground plane 21 and base plate 22, which hold connector pin 20. From the phase shift leads 19b the signals travel to the stripline feeders 18 through solder pin 23. Feed lines also get grounded at specific locations via plating at through holes 24. In an array, the multiple screws 16 can also serve the function of the edge 10 (see FIG. 1). The circuit board or ground plane 21 and base plate 22 form a cage in conjunction with the screws. These components also protect antenna from rain, erosion, moisture which would damage the diodes used in the phase shifters. The setting of the phase shifters is electronically controlled.

Specific dimensions of the preferred embodiment test unit are as follows: thickness of the cross slot board 15, 0.23 cm (0.090 inch); thickness of the feed line board 17, 0.23 cm (0.090 inch); thickness of the stripline hybrid board 19a, 0.079 cm (0.031 inch); thickness of the stripline circuit board and ground plane board 21, 0.079 cm (0.031 inch); and the thickness of the base plate 22. 0.318 cm (0.125 inch). The screws 16 were composed of brass to form a grounded cage structure.

Figure 5:
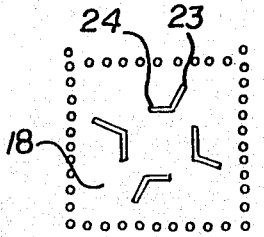
FIG. 5 shows a top view of a feed board.

FIG. 5 shows a top view of feed board 17, showing the pattern of the four feed lines 18 exciting each leg of slots 3 and 4 (not shown for clarity). These four feeders were excited by a two to four stripline feed circuit via the plated through holes 23. The plated through holes 24 are shorted to the ground plate to provide the desired match for each of the four feeders inside the cavity.

Figure 6:
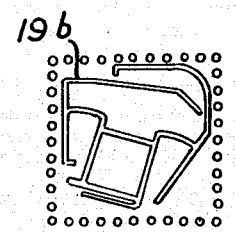
FIG. 6 shows a bottom view of hybrid board.

FIG. 6 is a bottom view of hybrid board 19a, showing the pattern of conductive lines or feeders 19b dividing and phase shifting the input radio frequency signal. The length of the path between solder pin locations and through holes determines phase shift from one point to another for a given frequency. The junctions of the path split (divide) the signal for each of the four feeders.

Table 1 presents the results of testing of two 19 element arrays previously described.

TABLE 1

| PARAMETER | MEASURED VALUE UNIT #1 | MEASURED VALUE UNIT #2 |
|---|---|---|
| Gain at 20 degree elevation angle (dBic) at 1545 MHz, average | 9.2 | 9.3 |
| Gain at 20 degree elevation angle (dBic) at 1660 MHz, average | 7.7 | 8.3 |
| Intersatellite Isolation (dB) | 26 | 26 |
| Backlobe (dB), 95% | 12 | 12 |
| Backlobe (dB), 5% | 6 | 6 |
| Multipath Rejection (dB)(pattern dropoff from 20 to 0 degree elevation) | >6 | >6 |
| Antenna Thickness, exclusive of RF Connector, cm (inch) | 1.73 (0.68) | 1.90 (0.75) |

While the geometry of the preferred embodiment has been described, many other geometries could be devised. While the length of the crossed slot element is typically related to a fraction of a wavelength (preferred embodiment length is approximately ½ wavelength, other configuration lengths are possible. Various other types of signal dividers/phase shifters could be used. The preferred embodiment uses plates, boards and other planar elements, but other geometric layered configurations, such as concave surfaces, cylinders or helixed arrangements could be implemented.

It should be noted that the invention presented here is a breadboard unit. Therefore, the cavity and the stripline circuit were bolted together, not bonded adhesively in order to easily disassemble and access unit. For production units, the printedcircuit crossed-slot element cavity could be bonded together, including the stripline feed circuit. The crossed-slot element could be integrated with the stripline feedthrough plate through holes and bonding, rather than bolted together.

While the preferred embodiment of the invention has been shown and described, as well as some other embodiments, changes and modifications may be made therein within the scope of the appended claims without departing from the spirit and scope of this invention.

What is claimed is:

1. An antenna connectable to a radio communication device for transmitting or receiving a radio frequency signal, said antenna consisting of:

a first printed circuit board including a first non-conductive substrate and a conductive layer electrodeposited on a first face of the first non-conductive substrate, said conductive layer having first and second symmetrical slots cross-intersecting at right angles through their centers, each slot having equal leg portions on either side of the other slot;

a second printed circuit board commensurate with said first printed circuit board, said second printed circuit board having a first side mounted against a second face of said first circuit board;

an array of four symmetrical stripline feeders electrodeposited on said first side, one end of each feeder being positioned under one of said leg portions distally from said centers to electro-magnetically couple to said leg portion;

printed circuit means for supplying quadrature phases of the signal to the stripline feeders;

a conductive grounding layer coupled to said stripline feeders;

means for holding said first and second printed circuit board, said means for supplying, and said ground layer in a stacked-layered configuration; and a conductive cage structure on the periphery of said first and second circuit boards.

2. The antenna as claimed in claim 1, wherein said ground cage consists of a plurality of conductive rods cincturing said slots.

3. The antenna as claimed in claim 2, wherein said signal is electromagnetically coupled to all four leg portions and the phase of the signals fed to any two adjacent, orthogonal leg portions is approximately 90 degrees apart and said signals are of equal magnitude.

4. The antenna as claimed in claim 3, wherein said stripline feeders are symmetrically placed in electromagnetic coupling arrangements with said leg portions.

5. The antenna as claimed in claim 1, wherein said means for supplying quadrature phases comprises:

a third printed circuit board commensurate with said first and second circuit boards, and having a third non-conductive substrate and a network of conductive straps electrodeposited on said third substrate;

said network having input terminals connectable to said radio communication device and four output terminals, each of said output terminals being electrically connected to one of said stripline feeders; and said conductive straps being routed and dimensioned to deliver opposite phases of said signal to opposite stripline feeders.

* * * * *